US007932008B2

(12) United States Patent
Kim et al.

(10) Patent No.: US 7,932,008 B2
(45) **Date of Patent: *Apr. 26, 2011**

(54) HYBRID TONER AND METHOD OF PREPARING THE SAME

(75) Inventors: In Kim, Suwon-si (KR); Kyung-yol Yon, Seongnam-si (KR); Sang-eun Shim, Incheon (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 522 days.

This patent is subject to a terminal disclaimer.

(21) Appl. No.: 12/003,199

(22) Filed: Dec. 20, 2007

(65) Prior Publication Data

US 2008/0160441 A1 Jul. 3, 2008

(30) Foreign Application Priority Data

Jan. 2, 2007 (KR) ..... 10-2007-0000301

(51) Int. Cl.
*G03G 9/093* (2006.01)

(52) U.S. Cl. ..... 430/110.2; 430/108.1; 430/108.6; 430/109.1; 430/109.3; 430/109.4

(58) Field of Classification Search ..... 430/110.2, 430/108.1, 108.6, 109.1, 109.3, 109.4
See application file for complete search history.

(56) References Cited

U.S. PATENT DOCUMENTS

| | | | | |
|---|---|---|---|---|
| 5,604,076 | A | 2/1997 | Patel et al. | |
| 5,858,602 | A * | 1/1999 | Yoshimura et al. | 430/135 |
| 6,132,919 | A * | 10/2000 | Ogawa et al. | 430/108.8 |
| RE39,517 | E * | 3/2007 | Ishihara | 430/110.2 |
| 7,282,312 | B2 * | 10/2007 | Jung et al. | 430/110.2 |
| 2003/0203301 | A1 * | 10/2003 | Iga | 430/108.1 |
| 2004/0229145 | A1 * | 11/2004 | Lee et al. | 430/108.6 |
| 2005/0064314 | A1 * | 3/2005 | Fujino et al. | 430/110.2 |
| 2005/0100809 | A1 * | 5/2005 | Fujino et al. | 430/110.2 |
| 2006/0269858 | A1 * | 11/2006 | McDougall et al. | 430/106.1 |
| 2008/0160442 | A1 * | 7/2008 | Kim et al. | 430/109.3 |

FOREIGN PATENT DOCUMENTS

JP 2-287551 11/1990

* cited by examiner

*Primary Examiner* — Hoa V Le
(74) *Attorney, Agent, or Firm* — Roylance, Abrams, Berdo & Goodman, L.L.P.

(57) ABSTRACT

A hybrid toner and a method of preparing the toner are provided. The hybrid toner is of a core-shell type having improved storage characteristics and a toner blocking phenomenon. The toner prevents image contamination caused by dispersion of waxes or colorants onto the surface of the outer layer of toner particles are prevented. The hybrid toner includes particles including: a core of about 100 parts by weight of a polyester-based resin, about 1-20 parts by weight of a wax, about 0.1-10 parts by weight of a colorant and about 0.1-10 parts by weight of a charge control agent; and about 5-500 parts by weight of a vinyl-based resin, about 0.1-10 parts by weight of silica, about 0.1-5 parts by weight of a metal oxide and about 0.1-10 parts by weight of polymer beads.

11 Claims, 1 Drawing Sheet

HYBRID TONER AND METHOD OF PREPARING THE SAME

CROSS-REFERENCE TO RELATED PATENT APPLICATION

This application claims the benefit under 35 U.S.C. §119 (a) of Korean Patent Application No. 10-2007-0000301, filed on Jan. 2, 2007, in the Korean Intellectual Property Office, the disclosure of which is hereby incorporated by reference in its entirety.

BACKGROUND OF THE INVENTION

1. Field of the Invention

The present invention relates to a hybrid toner for use in an electrostatic electrophotographic developing system and a method of preparing the toner. More particularly, the invention relates to a hybrid toner that has particles having a core-shell type structure, that prevent a toner blocking phenomenon and image contamination that are caused by the dispersion of waxes or colorants onto the surface of the outer layer of toner particles. The toner prepared according to the method of the invention provides improved storage characteristics of the toner.

2. Description of the Related Art

In an electrophotographic process or an electrostatic recording process, a developer used to form an electrostatic image or an electrostatic latent image may be a two-component developer, formed of toner and carrier particles, or a one-component developer, formed of toner only. The one-component developer may be a magnetic one-component developer or a nonmagnetic one-component developer. Plasticizers such as colloidal silica are often added independently into the nonmagnetic one-component developer to increase the flowability of the toner. Generally, coloring particles obtained by dispersing a colorant, such as carbon black, or other additives in a binding resin are used in the toner.

Methods of preparing toner include pulverization or polymerization methods. In the pulverization method, toner is obtained by melting and mixing synthetic resins with colorants and, if needed, other additives, pulverizing the mixture and sorting the particles until particles of a desired size are obtained. However, in a dry pulverization process, when an amount of wax included is greater than about 2.5 weight %, the durability and storage stability of toner decrease. Therefore, increasing the amount of wax in order to prevent offset and improve fixation of toner onto paper is undesirable. In addition, when toner is prepared using a pulverization method, it is inevitable that wax becomes embedded in the surface of the toner and protrudes outwardly during the pulverization step. This causes what is referred to as a toner blocking phenomenon, resulting in low image quality and poor storage stability of the toner.

Meanwhile, in a polymerization method, a polymerizable monomer composition is manufactured by uniformly dissolving or dispersing a polymerizable monomer, a pigment, a polymerization initiator and, if needed, various additives such as a cross-linking agent and an antistatic agent. Next, the polymerizable monomer composition is dispersed in an aqueous dispersive medium which includes a dispersion stabilizer using an agitator to shape minute liquid droplet particles. Subsequently, the temperature is increased and suspension polymerization is performed to obtain polymerized toner having coloring polymer particles of a desired size. In particular, there is a method of preparing a toner by forming core particles using a vinyl-based monomer and an initiator, and then forming a core-shell by polymerizing a vinyl-based monomer having the same hydrophilic property as that of the core particles and a higher glass transition temperature (Tg) than that of the core particles. However, in order to maintain the structure of the core-shell and improve the storage of toner, the core-shell has to be thick.

In particular, in electronic photocopiers, laser beam printers, electrostatic recording apparatuses or the like in which images are formed using electrophotography, electrostatic recording or the like, toner used to develop an electrostatic image requires a developer for fixation of toner onto paper at a low temperature required for high speed devices.

SUMMARY OF THE INVENTION

The present invention provides a hybrid toner used to develop an electrostatic image, using which a toner blocking phenomenon and offset are prevented. The toner provides improved fixation of the toner onto paper at a low temperature and excellent storage stability of the toner.

The present invention also provides a method of preparing the toner.

The present invention also provides a method of forming an image with high quality using the toner of the invention to provide low temperature fixation of the toner onto paper.

The present invention also provides an apparatus for forming an image with high quality using the toner of the invention to provide low temperature fixation of the toner onto paper.

According to an aspect of the present invention, a hybrid toner is provided comprising: a core comprising about 100 parts by weight of a polyester-based resin, about 1-20 parts by weight of wax, about 0.1-10 parts by weight of a colorant and about 0.1-10 parts by weight of a charge control agent; and a shell comprising about 5-500 parts by weight of a vinyl-based resin, about 0.1-10 parts by weight of silica, about 0.1-5 parts by weight of a metal oxide and about 0.1-10 parts by weight of polymer beads.

According to another aspect of the present invention, a method of preparing a hybrid toner is provided, comprising: mixing a polyester-based resin, wax, a colorant and a charge control agent to form a core; dispersing the core in a water-based solvent to form a core dispersion solution; adding a polymerizable monomer to the core dispersion solution, and then polymerizing the polymerizable monomer to form a shell on core particles, thereby forming particles having a core-shell structure; and adding silica, a metal oxide and polymer beads to the surface of the core-shell structure.

According to another aspect of the present invention, an image forming method is provided comprising: forming a visible image by disposing the hybrid toner of the invention on a surface of a photoreceptor on which an electrostatic latent image is formed; and transferring the visible image to a transfer medium.

According to another aspect of the present invention, an image forming apparatus is provided comprising: an organic photoreceptor; a unit for charging a surface of the organic photoreceptor; a unit for forming an electrostatic latent image on a surface of the organic photoreceptor; a unit containing the hybrid toner of the invention; a unit for supplying the toner to the surface of the organic photoreceptor to develop the electrostatic latent image on the surface of the organic photoreceptor into a toner image; and a unit for transferring the toner image on the surface of the organic photoreceptor to a transfer medium.

These and other aspects of the invention will become apparent from the following detailed description of the invention which disclose various embodiments of the invention.

BRIEF DESCRIPTION OF THE DRAWING

The above and other features and advantages of the present invention will become more apparent by describing in detail exemplary embodiments thereof with reference to FIG. 1.

DETAILED DESCRIPTION OF THE INVENTION

Figure 1:
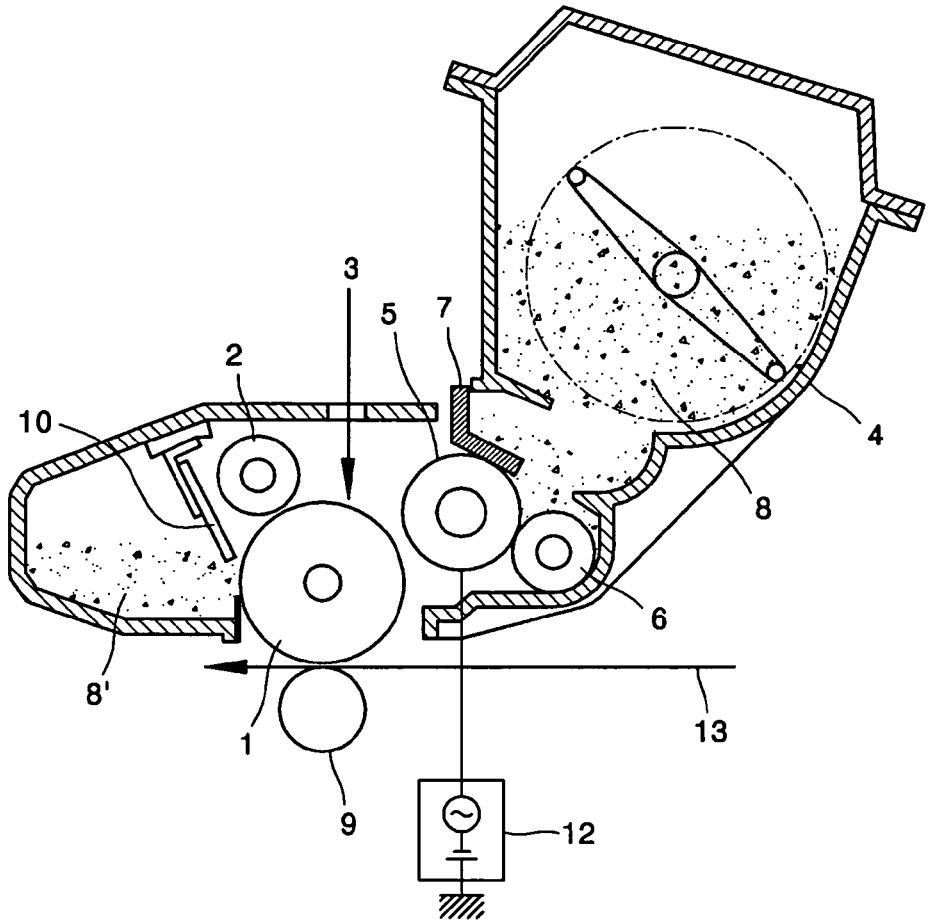
FIG. 1 illustrates an image forming apparatus including toner prepared using the method of the present invention, according to an embodiment of the present invention.

The present invention will now be described more fully with reference to the accompanying drawing, in which an exemplary embodiment of the invention is shown.

The present invention provides a hybrid toner that prevents a toner blocking phenomenon and offset, and provides an improved fixation of the toner onto paper at a low temperature, and which has excellent storage stability. Therefore, the hybrid toner can be used in developing an electrostatic image in electronic photocopiers, laser beam printers, electrostatic recording apparatuses or the like in which images are formed using electrophotography, electrostatic recording or the like.

The hybrid toner includes particles comprising: a core comprising a polyester-based resin; and a shell comprising unsaturated vinyls such as a styrene-based resin or an acrylate-based resin, which is formed on the outer surface of the core, such that the hybrid toner has a core-shell structure. The core can comprise a polyester-based resin with nothing added on the surface, which can be prepared by a conventional pulverization process. Alternatively, the core can be a polyester-based core formed using a polymerization method.

In this way, fixation of the toner onto paper at a low temperature and having a gloss suitable for graphic printing can be obtained by using a polyester-based resin as the core of the hybrid toner. In addition, the surface of the core is encapsulated by a shell comprising a vinyl-based resin. Thus, the toner particles can have improved storage stability and charging properties.

The polyester-based resin contained in the core includes a polyester moiety, and may have at least one reactive group selected from a vinyl group, an acrylate group and a methacrylate group. For example, the polyester-based resin including at least one selected from the group consisting of crystalline polyester resins such as ϵ-caprolactone, butyrolactone, caprolactam-lactone copolymer, styrene, divinylbenzene, n-butylacrylate, methacrylate and acrylate can be used alone or at least two of the polyester-based resins can be used in combination. The crystalline polyester resin has a melting point in the range of about 30-70° C.

The polyester-based resin may have a number average molecular weight of about 1,000-120,000, and preferably about 1,000-50,000. When the number average molecular weight of the polyester-based resin is less than 1,000, the durability of the toner is reduced. When the number average molecular weight of the polyester-based resin is greater than 120,000, fixation ability of the toner onto paper is reduced.

The polyester-based resin forms a core together with agents such as a wax, a release agent, a colorant, a charge control agent and the like.

The wax contained in the core of the toner may be appropriately selected according to the purpose of the final toner. Examples of the wax that can be used include polyethylene-based wax, polypropylene-based wax, silicone wax, paraffin-based wax, ester-based wax, carnauba wax and metallocene wax, but are not limited thereto.

The wax used in the toner according to the present invention may particularly have a melting point in the range of about 50-150° C. The wax having the melting point as described above can effectively exhibit releasing properties. The higher the melting point of the wax, the lower the dispersion of toner particles. The lower the melting point of the wax, the higher the dispersion of toner particles. However, the melting point of the wax may be in the range of about 50-150° C., taking into consideration inner environmental factors of an electrophotographic device in which the toner is actually used and fixation of final printed images. Components of the wax physically adhere to toner particles, but may not covalently bind with the toner particles. The wax is fused on a final image receptor at a low temperature, and the toner having excellent durability of final images and excellent rub-fastness is obtained.

The amount of the wax in the toner may be preferably about 1-20 parts by weight based on 100 parts by weight of the polyester-based resin, and more preferably about 1-10 parts by weight. When the amount of the wax is less than 1 part by weight, the releasing properties of toner decrease. When the amount of the wax is greater than 20 parts by weight, the durability of toner is reduced.

The release agent that is embedded in the core of the toner can be used to protect a photoreceptor and prevent deterioration of developing, thereby obtaining a high quality image. A release agent used in the present invention may be a high purity solid fatty acid ester material. Examples of the release agent include low molecular weight polyolefins such as low molecular weight polyethylene, low molecular weight polypropylene, low molecular weight polybutylenes, and other olefins; paraffin wax; multi-functional ester compound, and other suitable release agents as known in the art. The release agent used in the present invention may be a multi-functional ester compound obtained from an alcohol having three functional groups or more and a carboxylic acid. The amount of the release agent may be about 0.1-10 parts by weight based on 100 parts by weight of the polyester-based resin. When the amount of the release agent is greater than 10 parts by weight, the durability of the toner is reduced. When the amount of the release agent is less than 0.1 parts by weight, the releasing properties of the toner decreases.

The charge control agent that is embedded in the core of the toner may be preferably selected from the group consisting of a salicylic acid compound containing metals such as zinc, aluminium, boron complexes of bis diphenyl glycolic acid, and silicate. More preferably, dialkyl salicylic acid boron, boro bis(1,1-diphenyl-1-oxo-acetyl potassium salt), or the like can be used. The amount of the charge control agent may be about 0.1-5 parts by weight based on 100 parts by weight of the polyester-based resin. When the amount of the charge control agent is less than 0.1 parts by weight, the charging of toner deteriorates. When the amount of the charge control agent is greater than 5 parts by weight, the developing of the toner is not properly performed due to excessive discharge.

A colorant that is embedded in the core of the toner can be carbon black or aniline black in the case of black toner. The hybrid toner is efficient for preparing color toner. For color toner, carbon black is used as a black colorant, and yellow, magenta, and cyan colorants are further included for colored colorants.

For the yellow colorant, a condensation nitrogen compound, an isoindolinone compound, anthraquinone compound, an azo metal complex, or an allyl imide compound can be used. For example, C. I. pigment yellow 12, 13, 14, 17, 62, 74, 83, 93, 94, 95, 109, 110, 111, 128, 129, 147, 168, 180, and others can be used.

For the magenta colorant, a condensation nitrogen compound, an anthraquinone, quinacridone compound, base dye lake compound, naphthol compound, benzo imidazole compound, thioindigo compound, or perylene compound can be used. For example, C. I. pigment red 2, 3, 5, 6, 7, 23, 48:2, 48:3, 48:4, 57:1, 81:1, 122, 144, 146, 166, 169, 177, 184, 185, 202, 206, 220, 221, 254, and others can be used.

For the cyan pigment, copper phthlaocyanine compound and derivatives thereof, anthraquinone compound, or base dye lake compound can be used. For example, C. I. pigment blue 1, 7, 15, 15:1, 15:2, 15:3, 15:4, 60, 62, 66, and others can be used.

Such colorants can be used alone or in a combination of at least two colorants, and are selected in consideration of the desired color, chromacity, luminance, resistance to weather, dispersion property in toner, and the like.

The amount of the colorants can be any amount that sufficiently colors the toner, and may be about 0.1-10 parts by weight based on 100 parts by weight of the polyester-based resin. When the amount of the colorant is less than 0.1 parts by weight, the coloring effect of the colorant is insufficient. When the amount of the colorant is greater than 10 parts by weight, the cost for preparing the toner is increased, and a sufficient amount of friction charging can not be obtained.

To form a hybrid toner comprising particles having a core-shell structure according to the present invention, a shell is formed on an outer surface of the core. The shell can be formed using polymerizable monomers that are known to those of ordinary skill in the art. In various embodiments of the invention, the polymerizable monomer for forming the shell are ethylenically unsaturated monomers. The polymerizable monomer, for example, a styrene-based monomer, a (meth)acrylic acid-based monomer, a (meth)acrylate-based monomer or the like, can be used alone or in a combination of at least two polymerizable monomers. Examples of the polymerizable monomer are preferably at least one selected from the group consisting of styrene monomers such as styrene, vinyl toluene, α-methyl styrene; (meth)acrylate-based monomers such as (meth)acrylate, methyl(meth)acrylate, ethyl (meth)acrylate, propyl(meth)acrylate, butyl(meth)acrylate, 2-ethylhexyl(meth)acrylate, dimethylaminoethyl(meth) acrylate, (meth)acrylonitrile, (meth)acrylamide or the like; ethylenically unsaturated monoolefins such as ethylene, propylene, butylenes; halogenated vinyls such as vinyl chloride, vinylidene chloride, vinyl fluoride; vinyl esters such as vinyl acetate, vinyl propionate; vinyl ethers such as vinyl methyl ether, vinyl ethyl ether; vinyl ketones such as vinyl methyl ketone, methyl isopropylphenyl ketone; and nitrogen-containing vinyl compounds such as 2-vinylpyridine, 4-vinylpyridine, N-vinyl pyrrolidone. More preferably, styrene monomers, (meth)acrylate-based monomers or mixtures thereof can be used.

The vinyl-based resin that forms the shell can be in an appropriate amount with respect to the weight of the core. In particular, the amount of the vinyl-based resin may be about 5-500 parts by weight based on 100 parts by weight of the polyester-based resin, and preferably about 100-250 parts by weight. When the amount of the vinyl-based resin is less than 5 parts by weight, the formation of the shell is insufficient. When the amount of the vinyl-based resin is greater than 500 parts by weight, the shell becomes excessively thick.

The shell of the particles that constitute the hybrid toner can further include a variety of externally added components, using the vinyl-based resin as a main component. The externally added components can be silica, a metal oxide, polymer beads or the like.

The amount of the silica may be about 0.1-10 parts by weight based on 100 parts by weight of the polyester-based resin. When the amount of the silica is less than 0.1 parts by weight, the fluidity of toner is reduced. When the amount of the silica is greater than 10 parts by weight, image contamination occurs and images are unsatisfactorily developed.

The silica is commonly used as a dehumidifying agent, but the function of the silica can depend on the particle size thereof. A silica having a primary particle having a size of approximately 30 nm or more refers to a large-particle silica, and a silica having a primary particle having a size of less than 30 nm refers to a small-particle silica.

The term "primary particle" used herein refers to a unit particle of a compound in which polymerization, bonding or the like does not occur. The small-particle silica is mainly added in order to improve the fluidity of toner particles. The large-particle silica is added in order to charge the toner particles. The silica may comprise the small-particle silica and the large-particle silica in a predetermined amount ratio. That is, the amount of a small-particle silica having a primary particle size in the range of about 5-20 nm may be about 0.1-5 parts by weight based on 100 parts by weight of the polyester-based resin. On the other hand, the amount of a large-particle silica having a primary particle size in the range of about 30-200 nm may be about 0.1-5 parts by weight based on 100 parts by weight of the polyester-based resin.

The primary particle size of the small-particle silica and large-particle silica that are included in the externally added agents of the hybrid toner is determined by compatibility with toner particles and the size of toner particles themselves.

When the total amount of the silica is less than 0.1 parts by weight based on 100 parts by weight of the polyester-based resin, the fluidity and charging of toner, which are obtained by silica, are unexpected. When the total amount of the silica is greater than 10 parts by weight based on 100 parts by weight of the polyester-based resin, the charging is excessive, and thus the amount of charging toner particles can not be adjusted. Therefore, the total amount of the silica may be an appropriate amount, considering the problems as mentioned above.

The metal oxide, which is one of the externally added agents, includes titanium oxide. The amount of the titanium oxide may be about 0.1-5 parts by weight based on 100 parts by weight of the polyester-based resin. The titanium oxide can exist in a form having various acid values in addition to the form of $TiO_2$, but $TiO_2$ is the commonest form. The titanium oxide is dissolved in alkali to become alkali titanate. The titanium oxide is mostly used as a white pigment (titan white) having a high hiding power, and used in magnetic raw materials, an abrasive, medicines, cosmetics or the like. The titanium oxide adjusts the excessive charging occurring when only silica is used as an externally added agent. The titanium oxide may be surface-treated with alumina and an organo polysiloxane, and may have a primary particle size in the range of about 10-200 mn. The particle size of the titanium oxide can be determined by the size of toner particles and compatibility with toner particles as described above in the case of silica. The surface-treated titanium oxide may have a BET surface area of about 20-100 $m^2/g$.

The shell of the particles of the hybrid toner can further include polymer beads as an externally added agent in addition to the metal oxide and silica as described above. A styrene-based resin, methacrylic acid methyl, a styrene-methacrylic acid methyl copolymer, an acryl-based resin, an acryl-styrene copolymer or the like can be used alone or in combination as the polymer beads. The polymer beads are manufactured by a polymerization process such as suspension polymerization or the like, and are formed to be generally spherical. The particle size of the polymer beads can be various sizes in the range of submicrons to tens of microns. The polymer beads can be contained in the shell, in an amount of about 0.1-3 parts by weight based on 100 parts by weight of the polyester-based resin. When the amount of the polymer beads is less than 0.1 parts by weight, the charging is reduced. When the amount of the polymer beads is greater than 3 parts by weight, image contamination occurs.

The hybrid toner can further include various added agents in order to improve the functionality of the hybrid toner in addition to the added agents as described above. For example, an UV stabilizer, a mold inhibitor, bactericide, fungicide, an antistatic agent, a gloss modifying agent, antioxidant, an anti-caking agent such as silane or silicone-modified silica particles, or the like may be selected alone or a combination of at least the two types can be added to the hybrid toner as added agents. The amount of the added agent may be about 0.1-10 parts by weight based on 100 parts by weight of the polyester-based resin.

The hybrid toner may have an average particle diameter of about 4.0-12.0 μm.

The hybrid toner as described above can be prepared by the following processes.

First, polyester-based resins alone or two resin blends as a binder for toner are mixed with a wax, a colorant and a charge control agent as an internally added agent. The mixture is melted and mixed in an extruder, and then cooled, solidified, pulverized and sorted to form core particles. The obtained core particles are dispersed in a water-based solvent to form a core dispersion solution. Then, a polymerizable monomer is added to the core dispersion solution, and the resultant mixture is polymerized to form a shell, so that a core-shell structure is formed. Subsequently, various additives, for example, silica, a metal oxide, polymer beads or the like are added to the hybrid toner, which has particles having the core-shell structure. As a result, a hybrid toner according to the present invention is prepared.

In terms of any kinds of components used in the method of preparing a hybrid toner according to the present invention, a polyester-based resin, a wax, a colorant, a charge control agent, a polymerizable monomer, silica, a metal oxide, polymer beads and the like as described above can be used with amounts in the ratios described as above.

First, the process of forming the toner includes melting and mixing materials used to form a core in an extruder, and then cooling, pulverizing and sorting the resultant toner. The extruder and the melting/mixing process are known to those of ordinary skill in the art, and are not particularly limited. The pulverizing process can comprise two operations. The first operation is to pulverize cooled particles into medium-sized particles having a diameter of several mms. The second operation is to finely pulverize the pulverized particles into small-sized particles having a diameter of several-tens of sum. The finely pulverized particles are sorted to particles having a diameter of about 4-10 μm, and preferably about 6-8 μm.

The polyester-based resin, which is one of materials used to form a core, can be one particulate-type of resin or at least two resin blends. The polyester-based resin can be a polyester-based resin formed by polymerizing polyhydric alcohols or derivatives thereof and dicarboxylic acid compounds. The polyhydric alcohols may be a diol, and the equivalence ratio of the polyhydric alcohols and the dicarboxylic acid compounds may be in the range of about 1:1-1:2. The diol can be ethylene glycols, bisphenol derivatives or the like. The dicarboxylic acid compounds can be terephthalate, an adipic acid, an isophthalic acid or the like.

The polyester-based resin can be used in a particulate form together with materials used to form a core, such as a colorant, a pigment, wax or the like to be pulverized and sorted. However, core particles can be formed by dispersing the polyester-based resin in an organic solvent with a dispersant, mixing the resultant dispersion with extra materials used to form a core, and then adding a water-based solvent such as water or the like to the mixture to precipitate core particles. When the latter process is used, fine particles are formed in a mixed solution, and thus pulverization and sorting processes are not required. The organic solvent dispersing the polyester-based resin can be methylene chloride, tetrahydrofuran, dimethylsulfonic oxide or the like.

The core obtained in the process of forming a core is dispersed in a water-based solvent to form a core dispersion solution, and a polymerizable monomer is added thereto. The polymerizable monomer can be various types of monomers as described above, for example, a styrene-based monomer, a (meth)acrylate-based monomer or the like. The amount and ratio of the polymerizable monomer is the same as described above.

A dispersant, macromonomers, a stabilizer, an initiator or the like is added to the core dispersion solution comprising the polymerizable monomer, and then a polymerization process is performed to form a shell comprising a vinyl-based resin, which is formed on the outer surface of the core. That is, when a vinyl-based resin is prepared by polymerizing the polymerizable monomer in a water-based solvent comprising the core, the vinyl-based resin is insoluble in the core dispersion solution comprising the water-based solvent, and thus the vinyl-based resin exists in a precipitation form. The extracted vinyl-based resin is simultaneously absorbed onto core particles existing in the core dispersion solution to form a shell structure. As a result, a core-shell structure is formed.

The water-based solvent used to form a core dispersion solution in the process of forming a shell can be any water-based solvent that does not dissolve or solubilize the core particles comprising the polyester-based resin. The water-based solvent refers to a solvent itself having electric charges, and does not refer to a solvent comprising only water. Examples of the water-based solvent include water, alcohols or mixtures thereof. The core particles are not soluble in the water based solvent. The amount of the water-based solvent may be any amount that sufficiently disperses the core particles, and is not particularly limited.

The dispersant used in the process of forming a shell makes it easy for polymerized vinyl-based resins to be absorbed onto the surface of the core, without being agglomerated with each other. The dispersant can be any dispersant known to those of ordinary skill in the art. A reactive dispersant can be alkyl polyethoxy acrylate, alkyl polyethoxy methacrylate, aryl polyethoxy acrylate, aryl polyethoxy methacrylate or the like. Preferably, the dispersant may be HS-10, RN-10 (Product name, manufactured by Dai-ichi Kogyo Seiyaku Co., Ltd) or the like. The dispersant can have an appropriate amount known to those of ordinary skill in the art.

The macromonomers used in the process of forming a shell can stabilize particles during or after the process. The macromonomers are amphipathic materials having both a hydrophilic group and a hydrophobic group, and may be polymers or oligomers having at least one reactive functional group. The hydrophilic group of the macromonomers reacts with a medium to improve the water dispersion of the macromonomers, and the hydrophobic group thereof exists on the surface of toner particles, thereby being able to facilitate an emulsion polymerization reaction. The hydrophilic and hydrophobic groups bind with the polymerizable monomer by various methods such as grafting, branching, cross-link bonding or the like, thereby being able to form copolymers. The macromonomers can improve the durability of toner particles and anti-offset properties. In addition, the macromonomers form a stable micelle in the emulsion polymerization reaction, thereby being able to act as a stabilizer. The amount of the macromonomers may be about 0.1-100 parts by weight based on 100 parts by weight of the polymerizable monomer.

The weight average molecular weight of the macromonomers may be about 100 to 100,000, preferably about 1,000 to 10,000. When the weight average molecular weight of the macromonomers is less than 100, the physical properties of the toner are not improved or the toner cannot function efficiently as a stabilizer. When the weight average molecular weight of the macromonomers is greater than 100,000, the reaction conversion rate may be lowered.

The macromonomers may be a material selected from the group consisting of polyethylene glycol(PEG)-methacrylate, polyethylene glycol(PEG)-ethyl ether methacrylate, polyethylene glycol(PEG)-dimethacrylate, polyethylene glycol (PEG)-modified urethane, polyethylene glycol(PEG)-modified polyester, polyacrylamide(PAM), polyethylene glycol (PEG)-hydroxyethylmethacrylate, hexa functional polyester acrylate, dendritic polyester acrylate, carboxy polyester acrylate, fatty acid modified epoxy acrylate, and polyester methacrylate, but is not limited thereto.

The stabilizer used in the process of forming a shell stabilizes particles during or after the process. Examples of the stabilizer include poly(vinylalcohol), poly(vinylpyrrolidone), hydroxyl propylcellulose, poly(acrylic acid) and the like. The amount of the stabilizer may be about 0.1-100 parts by weight based on 100 parts by weight of the polymerizable monomer.

In the process of forming a shell, the polymerization process may be performed such that radicals are generated by an initiator, and the radicals react with the polymerizable monomer. The radicals react with a reactive functional group of the polymerizable monomer and the macromonomer to be able to form a copolymer.

Examples of the radical polymerization initiator include persulfate salts such as potassium persulfate, ammonium persulfate, and the like; azo compounds such as 4,4-azobis(4-cyano valeric acid), dimethyl-2,2'-azobis(2-methyl propionate), 2,2-azobis(2-amidinopropane)dihydrochloride, 2,2-azobis-2-methyl-N-1, 1-bis(hydroxymethyl)-2-hydroxyethylpropioamide, 2,2'-azobis(2,4-dimethyl valeronitrile), 2,2'-azobis isobutyronitrile, 1,1'-azobis(1-cyclohexanecarbonitrile) and the like; peroxides such as methyl ethyl peroxide, di-t-butylperoxide, acetyl peroxide, dicumyl peroxide, lauroyl peroxide, benzoyl peroxide, t-butylperoxy-2-ethyl hexanoate, di-isopropyl peroxydicarbonate, di-t-butylperoxy isophthalate, and the like. Also, an oxidization-reduction initiator in which the polymerization initiator and a reduction agent are combined may be used.

The present invention also provides toner prepared using the method according to the present invention as described above.

The present invention also provides an image forming method including: forming a visible image by disposing toner on a surface of a photoreceptor on which an electrostatic latent image is formed; and transferring the visible image to a transfer medium, wherein the particles of the toner have a core-shell structure obtained using a method of preparing toner according to the present invention as described above wherein the core comprises a polyester-based resin and the shell comprises a vinyl-based resin.

An exemplary electrophotographic image forming process includes charging, exposure to light, developing, transferring, fixing, cleaning, and antistatic process operations, and a series of processes of forming images on a receptor.

In the charging process, a photoreceptor is covered with electric charge of desired polarity, negative or positive charges, by a corona or a charge roller. In the light exposing process, an optical system, conventionally a laser scanner or an array of diodes, selectively discharges the charged surface of the photoreceptor in an imagewise manner corresponding to a final visual image formed on a final image receptor to shape a latent image. Electromagnetic radiation that can be referred to as "light" includes infrared radiation, visible light, and ultraviolet radiation.

In the developing process, appropriate polar toner particles generally contact the latent image of the photoreceptor, and conventionally, an electrically-biased developer having identical potential polarity to the toner polarity is used. The toner particles move to the photoreceptor and are selectively attached to the latent image by electrostatic electricity, and shape a toner image on the photoreceptor.

In the transferring process, the toner image is transferred to the final image receptor from the photoreceptor, and sometimes, an intermediate transferring element is used when transferring the toner image from the photoreceptor to aid the transfer of the toner image to the final image receptor.

In the fixing process, the toner image of the final image receptor is heated and the toner particles thereof are softened or melted, thereby fixing the toner image to the final image receptor. Another way of fixing is to fix the toner on the final image receptor under high pressure with or without the application of heat. In the cleaning process, remaining toner on the photoreceptor is removed. Finally, in the antistatic process, charges of a medium/body of the photoreceptor are exposed to light of a predetermined wavelength band and are reduced to a substantially uniform, low value, and thus the residue of the original latent image is removed, and the photoreceptor is prepared for a next image forming cycle.

The present invention also provides an image forming apparatus including an organic photoreceptor; a unit for charging a surface of the organic photoreceptor; a unit for forming an electrostatic latent image on a surface of the organic photoreceptor; a unit for containing a toner; a unit for supplying the toner to the surface of the organic photoreceptor to develop the electrostatic latent image on the surface of the organic photoreceptor into a toner image; and a unit for transferring the toner image on the surface of the organic photoreceptor to a transfer medium, wherein the particles of the toner have a core-shell structure obtained using a method of preparing toner according to the present invention as described above wherein the core comprises a polyester-based resin and the shell comprises a vinyl-based resin.

FIG. 1 is a schematic diagram of a non-contact developing type image forming apparatus 4 using a toner prepared using the method according to an exemplary embodiment of the present invention. The operating principles of the image forming apparatus are explained below.

A developer 8, which is a nonmagnetic one-component developer, is supplied to a developing roller 5 through a feeding roller 6 formed of an elastic material such as a polyurethane foam or sponge. The developer 8 supplied to the developing roller 5 reaches a contact point between the developing roller 5 and a developer regulation blade 7 as the developing roller 5 rotates. The developer regulation blade 7 is formed of an elastic material such as metal, rubber, or the like. When the developer 8 passes the contact point between the developing roller 5 and the developer regulation blade 7, the developer 8 is smoothed to form a thin layer that is sufficiently charged by the charging device 12. The developing roller 5 transfers the thin layer of the developer 8 to a developing domain where the thin layer of the developer 8 is developed on the electrostatic latent image of a photoreceptor 1, which is a latent image carrier. The latent image is formed by scanning light 3 onto the photoreceptor 1 by a scanning unit.

The developing roller 5 and the photoreceptor 1 face each other with a constant distance therebetween. The developing roller 5 rotates counterclockwise and the photoreceptor 1 rotates clockwise. The developer 8 transferred to the developing domain forms an electrostatic latent image on the photoreceptor 1 according to the intensity of an electric charge generated due to a difference between an AC voltage superposed with a DC voltage applied to the developing roller 5 and a latent image potential of the photoreceptor 1 formed by a charging roller 2.

The developer 8 developed on the photoreceptor 1 reaches a transferring device 9 as the photoreceptor 1 rotates. The developer 8 developed on the photoreceptor 1 is transferred through corona discharging or by a roller to a printing paper 13 as the printing paper 13 passes between the photoreceptor 1 and the transferring device 9. The transferring device 9 receives a high voltage with an opposite polarity to the developer 8, and thus forms an image.

The image transferred to the printing paper 13 passes through a fusing device (not shown) that provides high temperature and high pressure, and the image is fused to the printing paper 13 as the developer 8 is fused to the printing paper 13. Meanwhile, the developer 8 remaining on the developing roller 5 and which is not developed is transferred back to the feeding roller 6 contacting the developing roller 5. The above processes are repeated. Toner remaining in the photoreceptor 1 is collected by a blade 10 and stored as toner 8'.

The present invention will be described in more detail with reference to the examples below, but is not limited thereto. The following examples are for illustrative purposes only and are not intended to limit the scope of the invention.

A polyester-based resin that was used in the following examples was manufactured by Samyang Co., Ltd. under the tradename TM1. TM1 having a glass transition temperature (Tg) of 69° C., a softening temperature (Ts) of 135° C., a Gel amount of 3-5%, a number average molecular weight (Mn) of 8,000-9,000, a molecular weight polydispersity index (MWD) of 7-10, P1 having a glass transition temperature (Tg) of 60° C., a softening temperature (Ts) of 153° C., a Gel amount of 24-26%, a number average molecular weight (Mn) of 5,000-6,000, a molecular weight polydispersity index (MWD) of 7-10, and TLA1 having a glass transition temperature (Tg) of 54° C., a softening temperature (Ts) of 99° C., a Gel amount of 0.0%, a number average molecular weight (Mn) of 4,000-6,000, a molecular weight polydispersity index (MWD) of 2-5 were blended in the mixing ratio of 80:20 (wt. %) and 70:30(wt. %) and used.

EXAMPLE 1

—A Process of Forming a Polyester Core 88 parts by weight of TM1, 6 parts by weight of polyester wax, 3 parts by weight of carbon black, 3 parts by weight of MPT 313 titanium dioxide (Product name, manufactured by Ishihara Co., Ltd) were premixed in a Henschel mixer. Subsequently, the mixture was extruded in a modular corotating twin screw extruder including two regions of kneading blocks at a supplying speed of 3 rpm, a screw speed of 200 rpm, a screw torque of 80%, a resin temperature of 130-140° C. for an average remaining time of 4 kg/hr. Then, the resultant mixture was cooled and jaw crushed, and pulverized into medium-sized particles having a diameter of 1-2 mm using a Bantam Mill, finely pulverized into small-sized particles having a diameter of several to tens of μm in a crushing-sorting device, TR-15 (manufactured by NISSHIN Co., Ltd), and then sorted to particles having a diameter of 6-8 μm to prepare a core containing polyester.

—A Process of Forming a Core-shell Structure Using Unsaturated Vinyls, Styrene-based Resins.

10 g of the obtained core containing polyester particles, which had a particle diameter of 6-8 μm was added to 100 g of a mixed solvent (weight ratio 1:1) of alcohol and water, and then the mixture was stirred at a stirring speed of 500 rpm and dispersed to prepare a core dispersion solution. The polyester core particles was insoluble in the solvent.

Subsequently, 10 ml of styrene monomer was added to the core dispersion solution in which polyester core particles were dispersed. In addition, 0.1 g of HS-10 (manufactured by Dai-ichi Kogyo Seiyaku Co., Ltd), which was a surfactant, and 0.3 g of polyethylene glycol-ethylether methacrylate (PEG-FEM), which was macromonomer, were added to the core dispersion solution. Further, 0.5 g of poly(vinylalcohol) and 10 mg of an azo-based compound, AIBN (α-α'-azobisisobutyronitrile) as an polymerization initiator, were added to the core dispersion solution. Then, the temperature of the resultant was raised to within a polymer synthesis temperature of 85° C. and a polymerization process was performed to prepare a hybrid toner having a core-shell structure.

—A Process of Performing External Addition 1.2 parts by weight of a large-particle silica, 1.0 part by weight of a small-particle silica, 0.1 parts by weight of melanine-based polymer beads were mixed with 180 parts by weight of the core-shell structure and stirred at 3000 rpm for 6 minutes to prepare a hybrid toner according to the present invention.

EXAMPLE 2

—A Process of Forming a Polyester Core 91 parts by weight of TM1: TLA1 (a weight ratio of 80:20), 5 parts by weight of polyester wax, 2 parts by weight of carbon black, 2 parts by weight of titanium dioxide MPT 313 were premixed in a Henschel mixer. Subsequently, the mixture was extruded in a modular corotating twin screw extruder including two regions of kneading blocks at a supplying speed of 3 rpm, a screw speed of 200 rpm, a screw torque of 80%, a resin temperature of 130-140° C. for an average remaining time of 4 kg/hr. Then, the resultant was cooled and jaw crushed, and pulverized into intermediate-sized particles having a diameter of 1-2 mm using a Bantam Mill, finely pulverized into small-sized particles having a diameter of several to tens of μm in a crushing-sorting device, SR-15 (manufactured by NISSHIN Co., Ltd), and then sorted to particles having a diameter of 6-8 μm to prepare a core containing polyester.

—A Process of Forming a Core-shell Structure Using Unsaturated Vinyls, Styrene-based Resins.

10 g of the obtained core containing polyester, which had a particle diameter of 6-8 μm was added to 100 g of a mixed solvent (weight ratio 1:1) of alcohol, which was an insoluble solvent, and water, and then the mixture was stirred at a stirring speed of 500 rpm and dispersed to prepare a core dispersion solution.

Subsequently, 17.5 g of styrene monomer and 22.3 g of butyl acrylate were added to the core dispersion solution in which polyester core particles were dispersed. In addition, 0.1 g of HS-10 (manufactured by Dai-ichi Kogyo Seiyaku Co., Ltd), which was a surfactant, and 0.3 g of polyethylene glycol-ethylether methacrylate (PEG-FEM), which was macromonomer, were added to the core dispersion solution. Further, 0.5 g of poly(vinylalcohol) and 10 mg of an azo-based compound, AIBN (α-α'-azobisisobutyronitrile) as an polymerization initiator, were added to the core dispersion solution. Then, the temperature of the resultant was raised to within a polymer synthesis temperature of 85° C. and a polymerization process was performed to prepare a hybrid toner having a core-shell structure.

—A Process of Performing External Addition part by weight of a large-particle silica, 1.0 part by weight of a small-particle silica, 0.2 parts by weight of $TiO_2$, 0.3 parts by weight of melanine-based polymer beads were mixed with the core-shell structure and stirred at 3000 rpm for 6 minutes to prepare a hybrid toner according to the present invention.

EXAMPLE 3

—A Process of Forming a Polyester Core

Ethylene glycol and terephthalate with an equivalence ratio of 1:1.3 were added to a reactor and mixed together. 80 ppm of tetraethyl ammonium hydroxide was added to the mixture to maintain neutrality. Therefore, side reactions such as dimmer of aliphatic diol or the like can be prevented. An esterification reaction was performed at atmospheric pressure and 220° C. for 4 hours. Subsequently, to increase the molecular weight of the obtained polyester, 300 ppm of antimone trioxide and 100 ppm of trimethyl phosphate were added to the reactor, and the temperature of the resultant mixture was raised to 250° C. under a reduced pressure of 0.1 torr. Then, a polycondensation reaction was performed for 4 hours. As a result, a linear polyester resin having a number average molecular weight of 4,360, a molecular weight polydispersity index of 2.7, and a glass transition temperature (Tg) of 64° C. was prepared. Subsequently, 88 parts by weight of the obtained polyester resin was dissolved in methylene chloride, and 0.1 parts by weight of the surfactant HS-10 (manufactured by Dai-ichi Kogyo Seiyaku Co., Ltd) and 0.5 parts by weight of poly(vinyl)alcohol were added thereto to prepare a uniform dispersion solution. Then, 6 parts by weight of polyester wax, 3 parts by weight of carbon black and 3 parts by weight of MPT313 were added to the dispersion solution and mechanically stirred at 2,000 rpm. Thereafter, the resultant mixture was precipitated and washed with water to prepare polyester-based core particles having a diameter of 5-10 μm.

—A Process of Forming a Core-shell Structure Using Unsaturated Vinyls, Styrene-based Resins.

10 g of the obtained core particles containing polyester, which had a particle diameter of 5-10 μm was added to 100 g of a mixed solvent (weight ratio 1:1) of alcohol and water, and then the mixture was stirred at a stirring speed of 500 rpm and dispersed to prepare a core dispersion solution. The polyester core particles were insoluble in the solvent.

Subsequently, 10 ml of styrene monomer was added to the core dispersion solution in which polyester core particles were dispersed. In addition, 0.1 g of HS-10 (manufactured by Dai-ichi Kogyo Seiyaku Co., Ltd), which was a surfactant, and 0.3 g of polyethylene glycol-ethylether methacrylate (PEG-FEM), which was macromonomer, were added to the core dispersion solution. Further, 0.5 g of poly(vinylalcohol) and 10 mg of an azo-based compound, AIBN (α-α'-azobisisobutyronitrile) as an polymerization initiator, were added to the core dispersion solution. Then, the temperature of the resultant was raised to within a polymer synthesis temperature of 85° C. and a polymerization process was performed to prepare a hybrid toner having a core-shell structure.

—A Process of Performing External Addition 0.8 parts by weight of a large-particle silica, 1.0 part by weight of a small-particle silica, 0.1 parts by weight of $TiO_2$, and 0.3 parts by weight of melanine-based polymer beads were mixed with 180 parts by weight of the core-shell structure and stirred at 3500 rpm for 6 minutes to prepare a hybrid toner according to the present invention.

EXAMPLE 4

—A Process of Forming a Polyester Core 88 parts by weight of TM1: TLA1 (weight ratio of 70:30), 6 parts by weight of polyester wax, 3 parts by weight of carbon black, 3 parts by weight of MPT313 were premixed in a Henschel mixer. Subsequently, the mixture was extruded in a modular corotating twin screw extruder including two regions of kneading blocks at a supplying speed of 3 rpm, a screw speed of 200 rpm, a screw torque of 80%, a resin temperature of 130-140° C. for an average remaining time of 4 kg/hr. Then, the resultant was cooled and jaw crushed, and pulverized into intermediate-sized particles having a diameter of 1-2 mm using a Bantam Mill, finely pulverized into small-sized particles having a diameter of several to tens of μm in a crushing-sorting device, SR-15 (manufactured by NISSHIN Co., Ltd), and then sorted to particles having a diameter of 6-8 μm to prepare a core containing polyester.

—A Process of Forming a Core-shell Structure Using Unsaturated Vinyls, Styrene-based Resins.

10 g of the obtained core particles containing polyester, which had a particle diameter of 6-8 μm was added to 100 g of a mixed solvent (weight ratio 1:1) of alcohol and water, and then the mixture was stirred at a stirring speed of 500 rpm and dispersed to prepare a core dispersion solution. The polyester core particles were insoluble in the solvent.

Subsequently, 10 ml of styrene monomer was added to the core dispersion solution in which polyester core particles were dispersed. In addition, 0.5 g of poly(vinylalcohol) was added to the core dispersion solution. Furthermore, as a polymerization initiator, 0.01 g of potassium persulfate/p-methylbenzylaldehyde sodium bisulfate that was an oxidation-reduction initiator and dodecyl benzene sodium sulfonate were added to the mixture. A polymerization reaction was performed at room temperature at 500 rpm to prepare a hybrid toner having a core-shell structure.

—A Process of Performing External Addition 1.0 part by weight of a large-particle silica, 0.7 parts by weight of a small-particle silica, 0.2 parts by weight of $TiO_2$, and 0.2 parts by weight of melanine-based polymer beads were mixed with 180 parts by weight of the core-shell structure and stirred at 3500 rpm for 5 minutes to prepare a hybrid toner according to the present invention.

The hybrid toners having a core-shell structure of Examples 1 through 4 were added to a developer and tested in a contact and non-contact type printer. As a result, although the hybrid toners were printed on 5,000 sheets of papers, images having excellent durability and fixation, and high quality can be obtained.

According to the present invention, a hybrid toner is provided having a core-shell structure, wherein the core comprises a polyester-based resin, and the shell comprises a vinyl-based resin. Using the hybrid toner having advantages of the two resins, the storage characteristics of toner can be improved and a toner blocking phenomenon and image contamination, which are caused by waxes or colorants that are dispersed in the polyester-based resin being dispersed onto the surface of the outer layer of toner particles, can be prevented. In addition, high quality images through the durability and fixation improved by the introduction of the shell can be obtained.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A hybrid toner comprising:

core particles comprising about 100 parts by weight of a polyester-based resin, about 1-20 parts by weight of a wax, about 0.1-10 parts by weight of a colorant and about 0.1-10 parts by weight of a charge control agent; and a shell on the core particles comprising about 5-500 parts by weight of a vinyl-based resin obtained by polymerizing a monomer in the presence of a macromonomer selected from the group consisting of polyethylene glycol(PEG)-methacrylate, polyethylene glycol(PEG)-ethyl ether methacrylate, polyethylene glycol(PEG)-dimethacrylate, polyethylene glycol(PEG)-modified urethane, polyethylene glycol(PEG)-modified polyester, polyacrylamide(PAM), polyethylene glycol(PEG)-hydroxyethylmethacrylate, hexa functional polyester acrylate, dendritic polyester acrylate, carboxy polyester acrylate, fatty acid modified epoxy acrylate, and polyester methacrylate, the monomer being selected from the group consisting of a styrene-based monomer, a (meth)acrylate-based monomer, ethylenically unsaturated monoolefins, vinyl esters, vinyl ethers, vinyl ketones and nitrogen-containing vinyls, about 0.1-10 parts by weight of silica, about 0.1-5 parts by weight of a metal oxide and about 0.1-10 parts by weight of polymer beads.

2. The hybrid toner of claim 1, wherein the polyester-based resin has at least one reactive group selected from the group consisting of a vinyl group, an acrylate group and a methacrylate group.

3. The hybrid toner of claim 1, wherein the polyester-based resin has at least one selected from the group consisting of ϵ-caprolactone, butyrolactone, caprolactam-lactone copolymer, styrene, divinylbenzene, n-butylacrylate, methacrylate and acrylate.

4. The hybrid toner of claim 1, wherein the polyester-based resin has a number average molecular weight of about 1,000-120,000.

5. The hybrid toner of claim 1, wherein the wax has a melting point of about 50-150° C.

6. The hybrid toner of claim 1, wherein the colorant is carbon black, aniline black, a yellow colorant, a magenta colorant, or a cyan colorant.

7. The hybrid toner of claim 1, wherein the vinyl-based resin is obtained by polymerizing at least one polymerizable monomer selected from the group consisting of a styrene-based monomer, a (meth)acrylate-based monomer, ethylenically unsaturated monoolefins, halogenated vinyls, vinyl esters, vinyl ethers, vinyl ketones and nitrogen-containing vinyls.

8. The hybrid toner of claim 7, wherein the polymerizable monomer is polymerized in the presence of a dispersant, a polymerization initiator and a stabilizer.

9. The hybrid toner of claim 1, wherein the metal oxide is $TiO_2$.

10. The hybrid toner of claim 1, wherein the polymer beads are substantially spherical and are at least one selected from the group consisting of a styrene-based resin, methacrylic acid methyl, a styrene-methacrylic acid methyl copolymer, an acryl-based resin and an acryl-styrene copolymer.

11. The hybrid toner of claim 1, wherein the average diameter of the particles of the hybrid toner is in the range of about 4.0-12.0 μm.

* * * * *